US008434260B2

(12) United States Patent
Hilbert

(10) Patent No.: US 8,434,260 B2
(45) Date of Patent: May 7, 2013

(54) DECORATIVE SURROUND FOR PLANTS

(76) Inventor: Stuart Hilbert, Ann Arbor, MI (US)

( * ) Notice: Subject to any disclaimer, the term of this patent is extended or adjusted under 35 U.S.C. 154(b) by 0 days.

(21) Appl. No.: 12/976,158

(22) Filed: Dec. 22, 2010

(65) Prior Publication Data

US 2011/0083364 A1 Apr. 14, 2011

Related U.S. Application Data

(63) Continuation of application No. 11/900,265, filed on Sep. 11, 2007, now Pat. No. 7,874,102.

(60) Provisional application No. 60/847,693, filed on Sep. 28, 2006.

(51) Int. Cl.
*A01G 9/02* (2006.01)

(52) U.S. Cl.
USPC ..... 47/65.5

(58) Field of Classification Search ..... 47/65.5, 47/31.1, 39, 66.6; 119/61.54
See application file for complete search history.

(56) References Cited

U.S. PATENT DOCUMENTS

| | | | | |
|---|---|---|---|---|
| 1,762,082 | A | | 6/1930 | Shiraishi |
| 1,989,403 | A | | 1/1935 | Dauernheim |
| 3,043,053 | A | | 7/1962 | Peters |
| 3,498,268 | A | | 3/1970 | Langevin et al. |
| 3,734,062 | A | | 5/1973 | O'Hara |
| 3,783,555 | A | | 1/1974 | Peters |
| D243,390 | S | | 2/1977 | Mastrianni |
| 4,320,596 | A | | 3/1982 | Wirtz |
| 4,436,056 | A | * | 3/1984 | MacLeod ..... 119/72 |
| 4,643,380 | A | | 2/1987 | Copeland |
| 4,644,686 | A | | 2/1987 | Whitman |
| 4,858,381 | A | | 8/1989 | Walton et al. |

(Continued)

FOREIGN PATENT DOCUMENTS

| | | |
|---|---|---|
| DE | 201 10 862 U1 | 12/2001 |
| DE | 201 18 693 U1 | 2/2002 |

(Continued)

OTHER PUBLICATIONS

B&T Grower Supply, Inc., 1-800-748-6487, "Blow Molded Containers Trade 1 to Full 25 Gallon," obtained at the Internet address http://www.growersupply.com/blowmolcon.html, dated Aug. 12, 2006, 2 pages.

(Continued)

*Primary Examiner* — Monica Williams
(74) *Attorney, Agent, or Firm* — Brinks Hofer Gilson & Lione

(57) ABSTRACT

A decorative surround for potted plants is described. The surround may be a shell having a generally convex outer surface and an aperture in the shell suitable for either receiving or supporting a plant pot. The surround may be supported with respect to the ground or other reference surface by the periphery of the shell or by the bottom of a structure within the aperture, and the surround held against the ground by the weight of the potted plant. Alternatively, the surround may be affixed to the ground with pins or stakes. Another decorative surround is sized so that the aperture is smaller than a maximum diameter of the plant pot, and a strap is provided to hold the plant pot against an inner surface of the shell. The visible surface of the surround may be formed, textured or colored so as to have a visual appearance simulating natural rock.

4 Claims, 5 Drawing Sheets

U.S. PATENT DOCUMENTS

| | | | | |
|---|---|---|---|---|
| 4,914,860 | A | 4/1990 | Richardson | |
| 5,000,123 | A * | 3/1991 | Morse et al. | 119/61.54 |
| 5,477,640 | A | 12/1995 | Holtkamp, Jr. | |
| 5,867,938 | A | 2/1999 | DiLernia | |
| 6,219,967 | B1 | 4/2001 | Powell | |
| 6,421,955 | B1 | 7/2002 | Wilson | |
| D462,297 | S | 9/2002 | Rollins | |
| 6,698,136 | B1 | 3/2004 | Cleveland | |
| D506,295 | S | 6/2005 | Hammer et al. | |
| 6,976,334 | B1 | 12/2005 | Bowditch | |
| 7,124,709 | B1 | 10/2006 | Greer | |
| 7,516,718 | B2 | 4/2009 | Weinblatt | |
| 2003/0168016 | A1 | 9/2003 | Zolnierz et al. | |
| 2003/0208954 | A1 | 11/2003 | Bulk | |
| 2003/0230244 | A1 | 12/2003 | Morrison | |
| 2004/0187418 | A1 | 9/2004 | Day et al. | |
| 2005/0166853 | A1 * | 8/2005 | Plante | 119/74 |
| 2006/0288640 | A1 | 12/2006 | Leithold | |
| 2007/0199512 | A1 | 8/2007 | Ellis | |

FOREIGN PATENT DOCUMENTS

| | | | |
|---|---|---|---|
| DE | 20 2005 010 631 | U1 | 9/2005 |
| FR | 2401605 | | 3/1979 |
| FR | 2 557 761 | | 7/1985 |
| WO | WO 02/094052 | A1 | 11/2002 |

OTHER PUBLICATIONS

Dillen™ Products, "Injection-Molded & Pressure-Formed Nursery Containers from," obtained at the Internet address http://www.dillen.com/pro_cal_pots.asp, dated Aug. 12, 2006, 1 page.

greenhouseMEGAstore™, "Kord Regal Standard Pots," obtained at the Internet address http://www.greenhousemegastore.com/prodinfo.asp?number=CN-STD, dated Aug. 12, 2006.

greenhouseMEGAstore™, "Elite Nursery Container," obtained at the Internet address http://www.greenhousemegastore.com/prodinfo.asp?number=CN-NCE, dated Aug. 12, 2006, 1 page.

greenhouseMEGAstore™, "ITML Elite Azalea Pots," obtained at the Internet address http://www.greenhousemegastore.com/prodinfo.asp?number=CN-AZE, dated Aug. 12, 2006, 1 page.

International Search Report for International Application No. PCT/US2007/019825, dated Mar. 11, 2008, 5 pages.

Written Opinion of the International Searching Authority for International Application No. PCT/US2007/019825, dated Mar. 11, 2008, 7 pages.

Dec. 11, 2008 Non-Final Office Action, U.S. Appl. No. 11/900,265 (11 pages).

Response to Dec. 11, 2008 Non-Final Office Action, U.S. Appl. No. 11/900,265, filed in the PTO on Mar. 4, 2009 (11 pages).

Apr. 1, 2009 Final Office Action, U.S. Appl. No. 11/900,265 (9 pages).

Response to Apr. 1, 2009 Final Office Action, U.S. Appl. No. 11/900,265, filed in the PTO on Jul. 23, 2009 (9 pages).

Response to Aug. 11, 2009 Advisory Office Action and Apr. 1, 2009 Final Office Action, U.S. Appl. No. 11/900,265, filed in the PTO on Sep. 1, 2009 (9 pages).

Sep. 29, 2009 Non-Final Office Action, U.S. Appl. No. 11/900,265 (11 pages).

Response to Sep. 29, 2009 Non-Final Office Action, U.S. Appl. No. 11/900,265, filed in the PTO on Jan. 27, 2010 (7 pages).

Mar. 18, 2010 Final Office Action, U.S. Appl. No. 11/900,265 (13 pages).

Response to Mar. 18, 2010 Final Office Action, U.S. Appl. No. 11/900,265, filed in the PTO on Apr. 13, 2010 (9 pages).

Response to Apr. 23, 2010 Advisory Office Action and Mar. 18, 2010 Final Office Action, U.S. Appl. No. 11/900,265, filed in the PTO on Jun. 18, 2010 (10 pages).

Jul. 12, 2010 Non-Final Office Action, U.S. Appl. No. 11/900,265 (11 pages).

Response to Jul. 12, 2010 Non-Final Office Action, U.S. Appl. No. 11/900,265 filing in the PTO on Aug. 27, 2010 (6 pages).

* cited by examiner

Fig. 6a
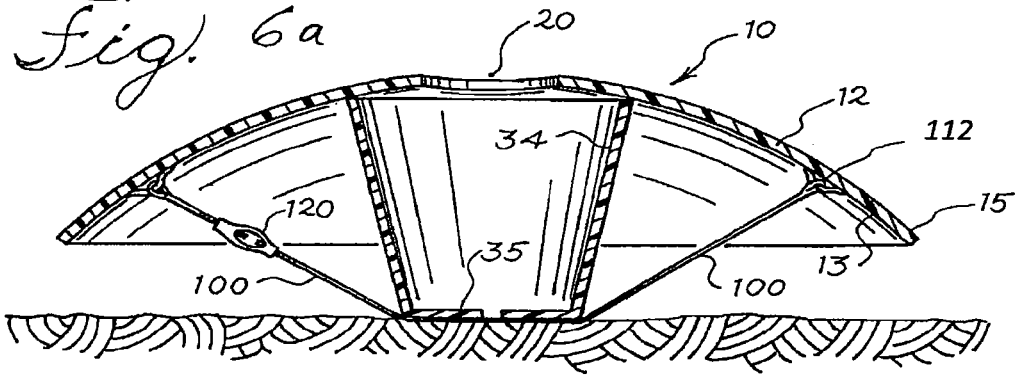
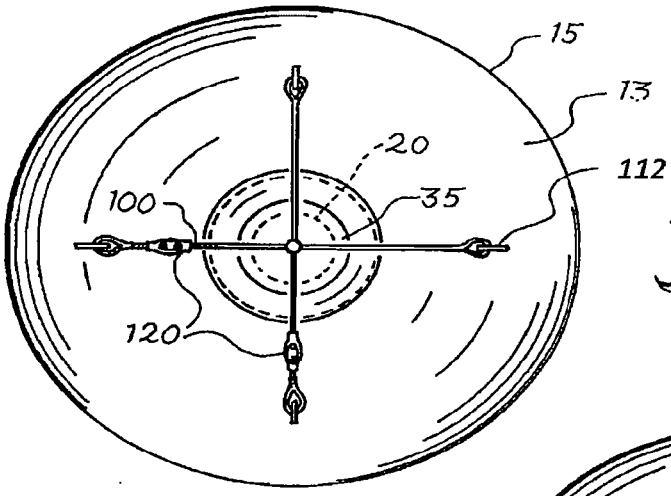
Fig. 6b
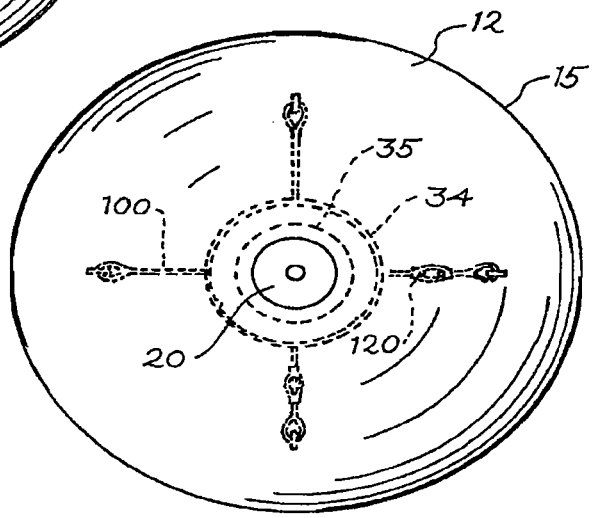
Fig. 6c

DECORATIVE SURROUND FOR PLANTS

This application is a continuation of U.S. application Ser. No. 11/900,265, filed on Sep. 11, 2007 now U.S. Pat. No. 7,874,102 which claims priority to U.S. provisional application Ser. No. 60/847,693, filed on Sep. 28, 2006, each of which is incorporated herein by reference.

TECHNICAL FIELD

The present application relates to container for plants or plants in pots. More specifically, a container structure may be used as decorative surround, so as to enable a plant to blend in more harmoniously with the environment.

BACKGROUND

Plants supplied by gardening supply companies, plant nurseries and similar sources are contained in pots of various types. Many of the pots are formed of black blow-molded plastic, molded plastic, terra cotta or other material that holds the potting material, which may be a soil or other material, and the vegetation, so that it may be displayed, sold, transported and subsequently planted. In many instances the plant remains in the pot provided at the time of purchase. In some circumstances this is done to facilitate the movement of the plant indoors at the end of the growing season, and in others merely for convenience. The supplied pot is often not aesthetically pleasing.

When such pots are used to contain plants in a water garden, a rock garden, or the like, the natural effect sought by the designer of the garden is compromised by the use of the supplied pot. A means to reduce or minimize the un-natural effect of the supplied pot would contribute to the success of the garden design.

SUMMARY

A container or surround is disclosed to provide a decorative or aesthetically pleasing covering, container, or surround for a provided plant pot.

In an aspect, the container has a generally circular perimeter and a convex surface shape presented to a viewer when placed on the ground surface. Within the perimeter of the container a generally circular aperture is formed in the surface of the convex surface. Within the aperture, a depression may be formed having approximately the shape of the exterior of a plant pot. The bottom of the depression may have holes for drainage, and the side surfaces of the depression may also have holes for drainage, or the passage or water. The convex exterior surface of the container faces the viewer and may be formed, textured, painted or coated or the material tinted in a manner that suggests a rock or other natural object. Alternatively, the container may be fabricated of a material having similar visual properties. In another alternative, the aperture may permit a plant pot to be placed beneath the aperture so that a bottom of the plant pot may be supported by the ground surface. The pot may be placed on the ground surface and the covering, container or surround placed on the ground subsequently so that the foliage or other vegetation projects through the aperture. The terms covering, container and surround are intended to be used substantially interchangeably herein unless otherwise specifically restricted.

In another aspect, the container has a closed perimeter and a substantially convex shape when placed on the ground surface and viewed from above. Within the perimeter of the container a generally circular aperture is formed. Along the edge of the aperture a lip is formed such that a substantially circular opening is formed in the aperture, the opening having a diameter slightly less than that of a provided pot, when the diameter of the opening is measured at the portion of the lip closest to the center of the opening. The opening is sized so as to permit the lower portion of the pot to protrude into a void formed below the convex surface, while an upper lip of the pot engages with the lip of the container so as to support the pot. In an aspect, the lip may be the perimeter of the aperture and may be of the same or substantially the same thickness as the container, or the lip may have a thickened portion.

In yet another aspect, a collar is provided, having a first lip sized to engage the lip in the aperture in the container surface, and a second lip protruding towards the center of the aperture so as to create another opening of a smaller diameter, so as to accept a smaller diameter provided pot, while engaging the upper lip.

In still another aspect, the container has a substantially closed perimeter and a substantially convex shape when viewed in the installed position. Within the perimeter of the container a generally circular aperture is formed. The container is sized and dimensioned so that it may be placed over a provided pot, allowing the foliage to project through the circular aperture, the diameter of the aperture being less that that of the provided pot. An adjustable strap is provided, which may be attached to the inner surface of the container and sized so that the strap may pass underneath a pot that has been positioned with respect to the aperture. The strap is adjustable so as to captivate the container to the provided pot, the assembly being maintained in a position in contact with a ground surface by the effect of weight of the provided pot on the strap passing beneath the pot.

The terms "generally circular" or "substantially closed", or the like, are intended to be broadly interpreted and encompass a range from a circle to a very irregular shaped perimeter. For example, a perimeter may define a planar area having a centroid. In an example, a radius from the centroid to the perimeter may form an angle with respect to a reference direction, and the angle may be monotonic as a function of the distance along the periphery. In contrast, the length of the radius may vary as a function of distance along the periphery and may be non-monotonic. This definition may be seen to encompass a triangular or other polygonal shape as well as a circle, and the shape may have a highly irregular periphery. This depiction is valid at least in a plane representing a contact surface between the periphery of the structure and a ground or other surface upon which it is to be placed. A person of skill in the art would appreciate that these terms are intended to encompass variations in form, shape, and dimension which may have, in part, esthetic value. Such esthetic value may include the property of the container visually appearing to be a natural object, such as a rock, a berm, or the like.

Similarly, the term "convex surface" is intended to be interpreted broadly, as it will be appreciated by persons of skill in the art that the surface may be deformed to give a better esthetic appearance, an may have locally flat or irregular regions, which may be inclined with respect to the ground contact surfaces, or regions of locally concave curvature superimposed on the generally convex shape so as to give a natural appearance or other desired esthetic effect.

The terms "ground", "support surface", or "reference surface" will be understood to represent the surface of the Earth, or a platform such as a roof, either on land or in water, upon which objects rest, and the objects may be held in place by the action of gravity, which may be supplemented by other means such as stakes. The ground may be only substantially flat, and therefore the contact between the contact surfaces of the container and the ground may be only substantially continuous.

BRIEF DESCRIPTION OF THE DRAWINGS

FIG. 6 is a (*a*) cross-sectional, (*b*) plan view from below, and (*c*) plan view from above of a third example of the container;

DETAILED DESCRIPTION

Figure 1:
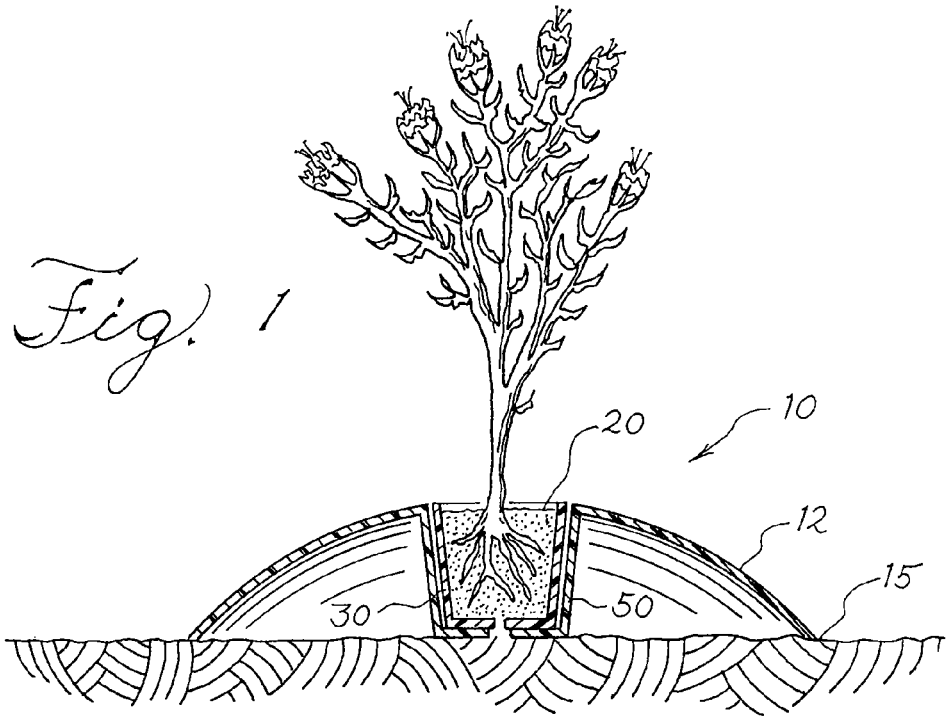
FIG. 1 is a cross-section of a first example of a container structure, having a pot inserted therein and resting on a ground surface.

Exemplary embodiments may be better understood with reference to the drawings, but these embodiments are not intended to be of a limiting nature. Like numbered elements in the same or different drawings perform equivalent functions.

Plants are often supplied by a nursery or a garden supply store in what may be intended to be temporary pots. The pots may be may be made, for example, of a black molded plastic, pottery, or the like. When such pots are used in a designed garden, the artificial color and surface may detract from the design of the garden. A container is disclosed which may substantially shield a view of the pot from the view of an observer.

A container or surround for receiving or retaining a pot is described. The container may be textured, shaped and colored to resemble natural stones or rocks in various environments and various sizes and manufactured of any artificial or manufactured material (such as, for example, petroleum or bitumen varietals, plastic, acrylic, fiberglass, neoprene, asphalt, polyester, fiber cement, fabric, polyester, waterproof bitumen membranes, density polyethylene geomembranes, and any treated waterproof bitumen membranes or waterproofed, or water resistant materials such as cesoplaster, hypolseal, or polyurethane coatings or different laminates, geosynthetic clay, rubber, treated wood, concrete, glass fiber, glass, waterproofed fiber cement, cork, fabric cement or metal, or combinations thereof). The container may be manufactured by molding, casting, lay-up of one or more materials on a form, or other means which will be apparent to persons of skill in the art, or may later be developed. The container may be formed in one operation or in several operations; separately manufactured pieces may be joined by cementing, gluing, bolting, riveting or other suitable technique or material. The container may intended to be totally or partially submerged in water environments, or used above ground in natural or artificial landscapes.

Herein, the word "container" is used to describe the structure and components, and is meant to encompass the terms "surround", "shroud", "pot", "planter", or the like. Any of the terms may ordinarily be used interchangeably herein, and a person of skill in the art would understand the structure being described.

The rock or stone shaped container has an opening to accept, for example, potted plants which may be in plastic, clay, ceramic or terra cotta pots. The container may have an exterior surface in a shape and with a color suggesting a natural rock or stone. The exterior surface of the container may be viewed by an observer when the container is positioned so as to be on the ground or other reference supporting surface. One or more apertures may be formed in the exterior surface, and the diameter of the apertures may be either larger or smaller than the diameter of the pots which may be inserted therein. The aperture in the container surface may accept the potted plants or seeds and may have perforated holes in the interior sides and bottom of the container for root access to water or soil. The bottom of the container may be perforated or removable to enable direct root access to water or soil, whereas the side perforations may allow access to the water or soil.

In an aspect, a container may be sized and dimensioned to accept a pot having, for example, a substantially frustro-conical shape, so as to modify the external appearance of the pot in which the plant is supplied or purchased. In another aspect, a container may have an aperture of a size such that a plant may project through the aperture, while the aperture may be smaller than a maximum dimension of the top of the pot providing the growing environment for the plant.

The container may be formed or molded to have a perimeter or periphery that encloses a shape that may be termed generally circular. The term circular is not meant in the strict geometric sense of a constant radius or an axially symmetric form, but the perimeter may be any curvilinear shape. The enclosed volume is the container. The center region of the container may be generally higher than the periphery, when the container is positioned so as to be viewable in an installed position. In this sense, the container has a convex shape.

In an aspect, a portion of the container may extend into the aperture and may extend downwards towards an imaginary surface formed by passing a plane through the periphery of the container; that is the container surface may continue through the aperture to from an inside surface of the aperture and further continue towards the imaginary plane on which the container is supportable. The shape of the downward extension may be generally frustro-conical or cylindrical, and the diameter thereof may become progressively smaller as the downward extension nears the imaginary plane. A plane parallel to the imaginary plane may form a lower closure of the downward extension. The dimensions of the aperture, the length of the downward extension and the diameter of the downward extension at the lower closure may be sized and dimensioned so as to accept a provided pot. Pots inserted into the cavity formed by the downward extension from the aperture in the surface of the container and the lower closure may be positioned such that the top lip of the pot is below the surface of the container. The pots may be of any diameter less than or equal to the diameter of the aperture.

In an aspect, the lower closure may be co-planar with, or below the imaginary surface that is coplanar with the periphery of the container. In this circumstance, the weight of the provided pot may press the outer surface of the lower closure onto the imaginary surface, which may be the ground or roof, serving to restrain the container from movement or overturning by wind.

The lower closure may have one or more holes therein to provide for water drainage. Holes may also be provided in the wall of the downward extension for similar drainage purposes, or to permit the entry of water in a water garden use.

Commonly, gardeners may place a quantity of stones or gravel in the bottom of a pot to facilitate drainage. Such stones may be placed on the inner surface of the lower closure. Alternatively, the lower closure may be formed with ridges or upward projections so that the provided pot has a space between a portion of the lower surface of the provided pot and the upper surface of the lower closure. When a space exists between the provided pot and the inner side walls of the downward extension, soil, gravel, moss, or the like may be backfilled to secure the provided pot in the container and control the local environment.

In another aspect, the downward extension may extend a distance below the aperture and then be bent inward so that a portion of the extension faces towards the center of the aperture, forming a circular aperture in the downward extension. The inward bent portion may be termed a lip and, in cross-section, may have an L shape, with the lower element of the L facing towards the center of the aperture. Other lip geometries may be used including a ring or half round, or the like. When a plant pot of suitable diameter is inserted in to the aperture in the container, the lower portion of the pot may project into a void inside the container, or the cavity defined by the frustro-conical surface, and the top lip region of the provided pot may engage with the lip in the container aperture such that the provided pot hangs into the region below the lip. Alternatively, the pot may fit into the aperture so that the pot lip does not engage with the container lip, and the bottom of the pot rests, for example, on the lower closure.

The aperture may be adapted to accept provided pots of sizes less than that of a maximum diameter pot, while supporting the pot by the lip. An insert comprising a cylindrical section, having a first lip projecting away from the center of the cylinder, and a second lip projecting towards the center of the cylinder may be sized and dimensioned such that the first lip engages with the lip of the container when the insert is placed in the container aperture, and the second lip of the insert functions similarly to the container lip for a smaller diameter provided pot.

The container may be secured in place by the weight of the provided pot pressing the periphery of the container onto the ground surface. Alternatively, a lip or tabs may be provided around the periphery of the container, having holes through which pins may be driven into the ground to secure the container.

In a further aspect, the container may comprise a substantially circular convex shape having an aperture in a central region thereof. A first strap and a second strap may be attached to an inside surface of the container. Each strap may be positioned such that a projection of the straps in the horizontal plane intersects in a region where the base of a provided pot would rest when the pot is positioned beneath the center of the container aperture. The straps may be attached to the container by rivets, bolts, adhesive, or to a tab molded into or adhered to the container. The strap may be made of any suitable engineering material that has the required strength and durability in an outdoor environment. In an alternative, a single strap may be used.

The straps may be adjustable in length by any of any known means such as buckles, or by the use of self-adhering materials such as VELCRO, or other adhesive substance. The straps are passed under the pot placed beneath the container aperture, and adjusted so as to generally hold the top of the provided pot against the interior surface of the container such that vegetation in the pot may project through the aperture in the container.

While the description and drawings explain configurations having a single aperture, a container with multiple apertures is equally possible, and the apertures may be of dissimilar sizes. Further, the use of the term convex may include a surface which is generally flat and has vertical or substantially vertical edge walls around the periphery or the visible surface so as to imitate a flagstone, cut stone, or other rock arrangements having substantially flat surfaces, in whole or in part.

FIG. 1 is a cross-sectional view of a first example, where the container 10 rests on a ground surface 40, with a periphery 15 thereof in contact with the ground surface 40. An aperture 20 is provided in a central area of the surface 12 of the container 10, being sized and dimensioned to accept a provided plant pot 30. As shown, the plant pot 30 rests on a lower surface 60 of the container 10, which is, in turn, in contact with the ground 40. However, it should be understood that different dimensions are possible such that the lower surface 60 is not in contact with the ground 40 and the weight of the assembly may be borne by the periphery 15 of container 10 in contact with the ground 40.

Alternatively, the lower surface 60 of the container 10 may be in contact with the ground 40, and the periphery 15 of the container 10 may be raised above the ground surface 40 so that the weight of the assembly is borne by the lower surface 60. Intermediate situations are also possible, as it will be appreciated that the ground in a terrestrial garden or water garden may not be level. The lower surface 60 faces the aperture 20 in the surface 12 of the container 10, and the volume therebetween is bounded by a frustro-conical or conical surface 50.

The region between the frustro-conical surface 50, connecting the aperture 20 in the surface of the container 10 with the lower surface 60, the container exterior surface 12 and the ground 40 may be substantially void. Where the thickness of the container in the region of the surface 12 of the container is small relative to the size of a pot 30, the structure of the container may be termed a shell.

Figure 2A:
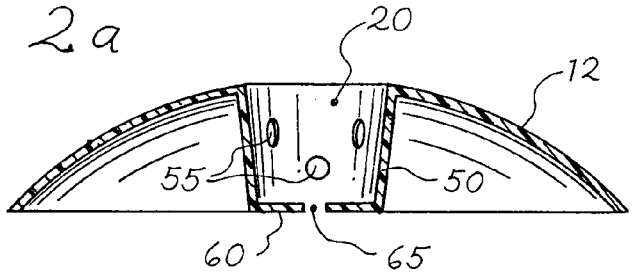
FIG. 2 is a cross-sectional and plan view of detail A of FIG. 1, with the pot removed.
Figure 2B:
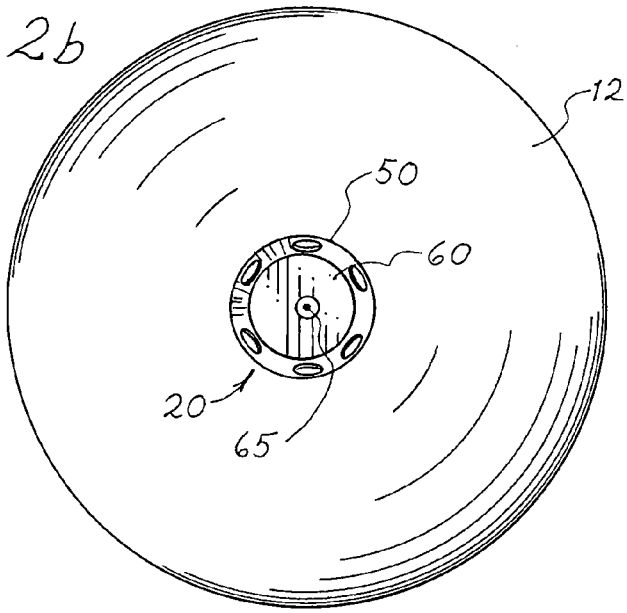

FIG. 2 is a cross-sectional (a) and a plan view (b) of a portion of the container 10 (detail A). The aperture 20 may have a diameter slightly larger than the maximum diameter of the pot 30 to be inserted therein. The surface 50, connecting the aperture 20 in the container exterior surface 12 to the lower surface 60 may have a generally frustro-conical form, or may extend between the aperture 20 and the lower surface 60 as a cylindrical surface. The surface 50 may be formed so as to increase structure rigidity by the use of ribs, molded variations in thickness or the like. The pot 30 (not shown) may fit into the volume defined by the aperture 20, side wall 50 and lower surface 60 without touching the side wall 50, however an interference fit is not precluded, and may occur depending upon the shapes of the pot 30 and the side wall 50.

An aperture 65 may be formed in the lower surface 60 and one or more ribs (not shown) may be formed in the lower surface 60 so as to support the base of the pot 30 above the lower surface 60 so that the roots may gain access to the soil in the ground exterior to the lower surface 60, or so that water may freely move between the lower surface 60 and the pot 20. The ridges may be either linear or circular. Openings in the ridges may be provided to facilitate the flow of water. Additional openings 55 may be provided in the side wall 50.

Figure 3:
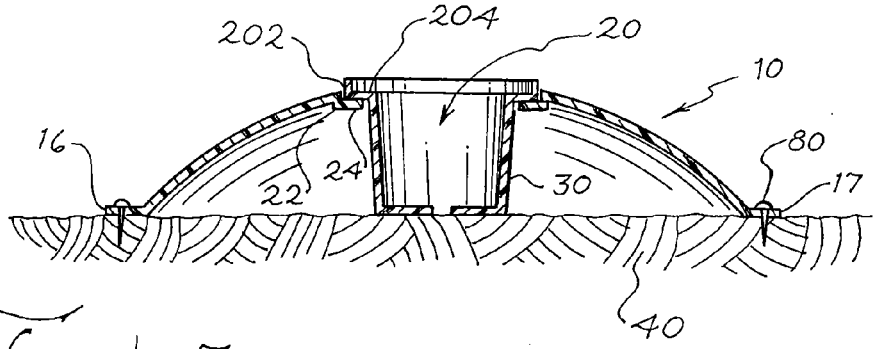
FIG. 3 is a cross-sectional view of a second example of the container structure.

FIG. 3 is a second example of a container for receiving a pot 30. Pots 30 may have a generally frustro-conical shape as shown, or be cylindrical or substantially cylindrical in cross section. A top lip structure 202, 204 may be formed in the pot 30 and has various purposes related to the handling and storage of pots, and may also have esthetic purposes. In this example, the lip structure 202, 204 may engage a corresponding lip structure 22, 24 disposed in the aperture 20 of the exterior surface 12 of the container 10. Pot 30 may be introduced into the aperture 20, and descend into the interior of the container 10 until the lip structure 202, 204 of the pot engages the lip structure 22, 24 of the container 10. When the corresponding lip structures are thus engaged, the weight of the pot 30 is borne by the lip structure 22, 24 of the exterior surface 12 of the container 10, and the weight of the pot 30 and the container 10 transferred to the ground 40 through the periphery 15. When the height dimension of the pot 30 between the bottom of the pot and the pot lip is greater than the distance between the ground 40 and the lower portion 24 of the container lip, the pot 30 may rest on the ground 40 without engaging the container lip structure. The pot lip may not engage the container lip if the diameter of the pot is sufficiently smaller than the diameter of the aperture.

Generally plants are supplied in pots having a cylindrical axis of symmetry, however, an aperture may be provided in other shapes, such as a square or rectangle, in order to adapt to other cross-section plant pots. The shape of the surface 50, 60 would be modified accordingly.

Tabs 17 may be provided at the periphery 15 of the container 10. The tabs may be in the form of a continuous lip, or individual tabs. Where individual tabs 17 are provided, typically three tabs are used, although there may be more or fewer tabs, the tabs each having an aperture (not shown) therein, so that a pin 80 or stake may be driven into the ground 40 to secure the container 10 in place. This may be useful in areas with high winds, or where the pot lip does not engage the container lip. Alternatively, a hole may be provided in the exterior surface 12 of the container 10 proximate to the periphery 15 so that the pin 80 may be inserted into the hole and driven into the ground so as to secure the container 10 in place. The thickness of the container may be increased in the region of a hole to provide greater structural integrity. As the hole passes through the thickness of the container surface, the direction of the hole may be inclined from the vertical so that the pin 80 may enter the ground at a pre-determined angle.

Figure 4:
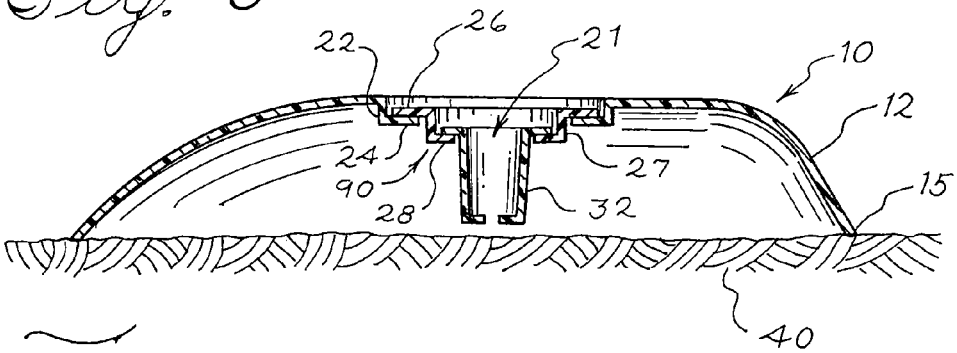
FIG. 4 is a cross-sectional view of the second example with an insert to permit use of a smaller diameter pot.

FIG. 4 shows the example of FIG. 3 adapted to receive pots of smaller maximum diameter than that of the aperture 20 in the exterior surface 12 of the container 10. An insert 90 may have a generally disk-like form with an outer diameter such that the insert 90 may be placed in the aperture 20 of the exterior surface 12 of the container 10 and be supported by the lip 22, 24 thereof. The insert 90 has an a first surface 26, and a second surface 27 disposed approximately orthogonal to the first surface, and a third surface 28 which may be a lip or protrusion extending towards the center of the insert 90. The insert 90 is sized and dimensioned so that a portion of the first surface 26 may contact a portion of the container lip 24, and an edge of the third protrusion or surface 28 projects towards the center of the insert 90, creating an aperture 21. The aperture 21 and the projection of the third surface 28, are sized and dimensioned to engage a pot 32 having a smaller maximum diameter than that of the pot 30. In this manner, a pot 32 having dimensions which may preclude engaging the pot lip with the container lip, may be supported in a hanging manner in the container aperture.

Figure 5:
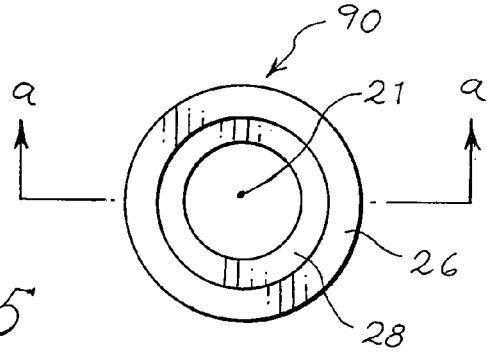
FIG. 5 is a plan and cross-sectional view of the insert of FIG. 4.
Figure 5A:
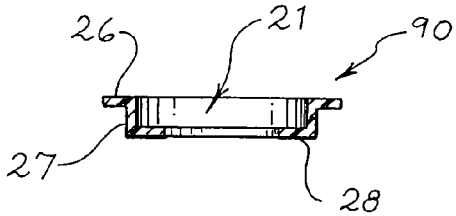

FIG. 5 shows details of the insert 90. The first surface 26 may be sized so as to engage with the lip 22, 24 of the aperture 20. An outer diameter of the insert 90 may, for example, be less than or equal to the diameter of the aperture 20, however the outer diameter of the insert 90 is sufficiently large so that the surface 26 engages with the lip 24. The second surface 27 may be a cylinder or a section of a frustro-conical shape and extend downwards from the first surface 26. The third surface 28 may be formed near or at the lower end of the second surface 27, and may be a planar surface as shown or other structure suitable for engaging with the lip of a pot 32 (not shown), when the pot 32 is introduced into the aperture 21. The insert 90 may be made of any suitable engineering material.

When a pot 32 is supported by an insert 90, the area between the pot lip and the upper surface 12 of the container may be esthetically improved, if desired, by the addition of soil, gravel or the like.

FIG. 6 shows a third example of the container 10 having an aperture 20 with a diameter smaller than the maximum diameter of the pot 34. The container rests on the upper portion of the pot 34. FIG. 6*b* is a view of the underside of the container 10 with a pot 34 in place. The container 10 is secured to the pot 34 by straps 100. The straps 100 may be a webbing, such as fiberglass or a plastic structure that is flexible and durable in the environmental conditions expected in a garden or water garden. Each end of the strap 100 is attached the inner surface 13 or the periphery 15 of the container 10 by, for example, bolting, gluing or the like, and the strap 100 is positioned so that may pass under the bottom 35 of the pot 34. The length dimension of the strap 100 may be adjusted so that the top of the pot 34 makes contact with the inner surface 13 of the container 10. A second strap 100 may be positioned approximately orthogonally to the first strap 100. Other strap configurations are possible. The strap 100 may be attached to the inner surface 13 of the container 10 by other techniques such as a snap fastener, or engage with a preformed opening in a lip in the periphery, or the like.

The length dimension of the strap 100 may be adjustable to adapt to differing size pots 35. In an aspect, the strap 100 may be formed in two pieces, and a buckle arrangement, as is known in the art, may be used to adjust the length of the strap. Alternatively, the strap 100 may be formed in two pieces and a self-adhering portion, may be used to joint the two pieces together in an adjustable manner. Where self-adhering materials are used, the contact area between the portions should be sized and dimensioned so that the joining force is sufficient to resist environmental conditions. This force may be supplemented by positioning the join so that the weight of the pot and the container 10 is applied on the portion surface of the strap 100 opposite to that contacting the ground, or by the use of a mechanical clamp, or adhesive applied after the length of the strap has been established by the self-adhering material.

In another alternative, the strap 100 may be made in one piece, and one end fixed attached to the container 10 as described. The other end of the strap 100 may be threaded through a ring (not shown), which may be a D-shaped ring, attached to the container and a self-adhesive portion may be used to join and end region of the strap 100 to another portion of the strap 100 having a compatible self-adhering material. When the pot 34 is secured against the inner surface 13 of the container 10, and the pot 34 is set on the base 35 thereof, the strap 100 is captivated between the base 35 and the ground 40 by the weight of the container 10 and the pot 34, thus holding the assembly in place. The periphery 15 of the container 10 may not extend downwards by the height of the pot 34 and a gap may be left between the ground 40 and the periphery 15 of the container 10. Such an arrangement may be useful, for example, in a water garden. A person of skill in the art will appreciate that the ground 40 may represent the surface of a terrestrial garden or the interior surface of the underwater portion of the water garden.

Figure 7A:
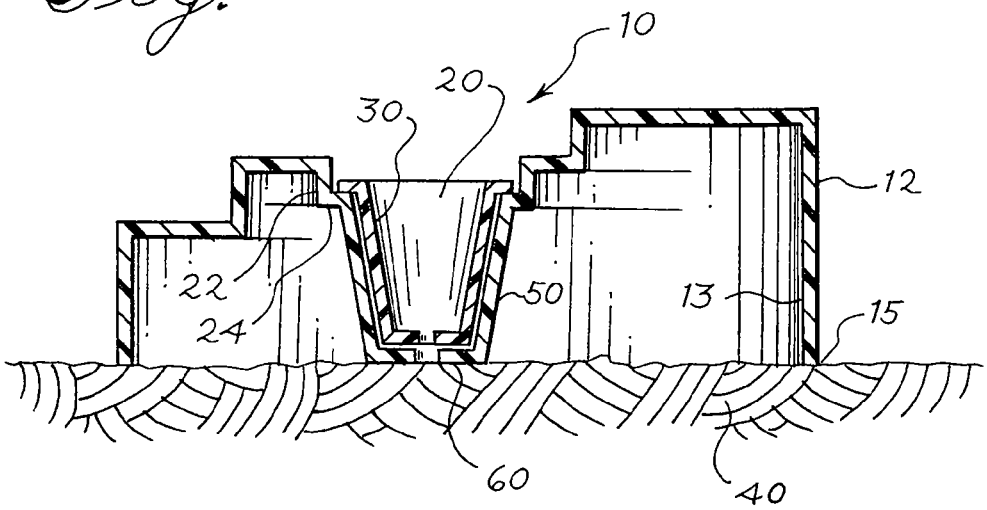
FIG. 7 (*a*) is a cross-sectional view of a fourth example of the container structure; and, (*b*) the container structure with inserts.

FIG. 7*a* shows fourth example of the container illustrating a flat rock-like shape having a generally convex surface. An aperture 20 is formed in the surface 12 of the container and a lip structure including a first surface 22 and a second surface 24 extends below the surface 12 into the aperture 20. A frustro-conical surface 50 extends from the lip structure to a bottom closure 60. The closure surface is located with respect to the container surface 12 so that the weight of the assembly may be borne on the periphery 15 of the container surface 12, in which circumstance the bottom closure does not substantially contact the ground 40, or the closure surface may be located such that the weight of the assembly may be borne on the bottom closure 60, in which circumstance the periphery 15 may not substantially contact the ground 40. Whether the bottom closure 60 or the periphery 15, or both structures bear the weight of the container and pot may depend on the characteristics of the ground surface, which is typically uneven or irregular.

A pot 30 may be inserted into the space formed by the aperture 20 and the frustro-conical surface 50 and may either be supported by the container lip 22, 24, or by resting on the bottom closure 60, depending on the relationship of the diameter of the pot 30 and the shape of the pot 30 to the diameter of the aperture 20, the extension of the lip 24 towards the center of the aperture 20, the angle of the frustro-conical surface 50, and the distance of the bottom closure below the surface 12 of the container 10.

An insert 110*a* may be formed as a substantially planar disk with an aperture 21 formed therein. The diameter of the insert 110*a* may be less than the diameter of the aperture 20 so that, for example, the insert 110*a* may rest on the lip structure of the container 10. A pot 32 (not shown) may be inserted into the aperture 21 and, providing that the maximum diameter of the pot 32 is greater than the aperture 21, the pot 32 may be supported by the insert 110*a*. A second insert 110*b* may be a disk having a diameter less than that of the aperture 20 but greater than the aperture 21, and may be placed on top of the first insert 110*a*. The second insert 110*b* may have an aperture 22 formed therein, where the diameter of the aperture 22 may be smaller than the diameter of the aperture 21. In this situation, the first insert 110*a* provides support for the second insert 110*b*, which may further support a pot 36 having a maximum diameter that is less than that of the aperture 21, but greater than that of the aperture 22. A portion of the surfaces of the insert 110*a* and an opposing surface of the lip 24, for example, may be deformed in a complimentary manner such that the opposing surfaces may engage in a locking or snap-in arrangement.

Figure 8A:
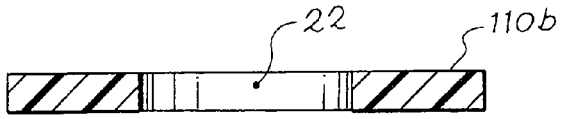
FIG. 8 (*a*) is a cross sectional and plan view of one of the inserts; (*b*) is a cross-sectional view showing a strengthening element; (*c*) and (*d*) are cross sectional views showing another strengthening element; and (*e*), is a cross sectional view showing a detail of the container structure having a pot-like insert member.
Figure 8B:
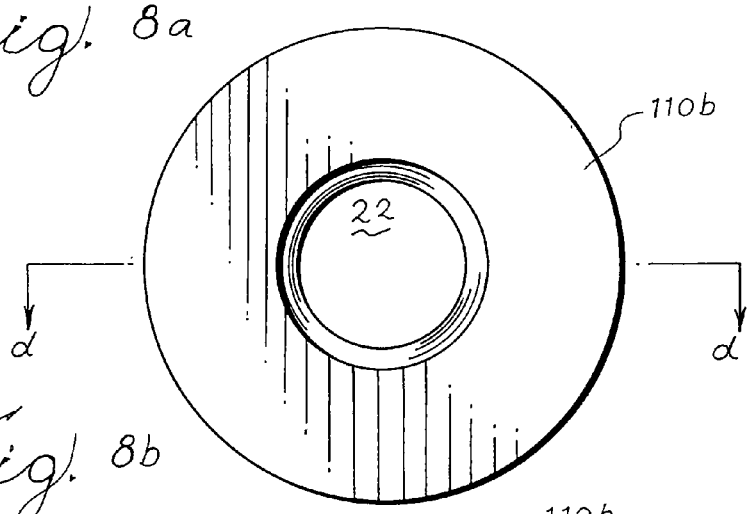

In FIG. 8*a* and FIG. 8*b*, the insert 110*b* is shown in cross-sections and plan views, respectively. The aperture 22 is formed in the surface thereof such that the remainder of the disk is an annulus. Although the aperture is shown as centered in the disk, and this example, as with the other examples, is shown as a generally symmetrical object for convenience of illustration; this should not be taken to suggest that such a limitation is intended.

Figure 8C:
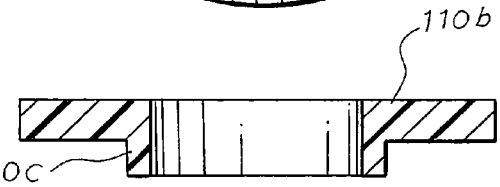
Figure 8D:
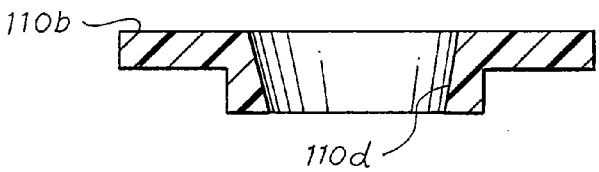

FIG. 8*c* shows a cross-section of an insert 110*b* where a strengthening member 110*c* is formed around the inner edge of the annulus. FIG. 8*d* shows a cross section of an insert 110*b* where the strengthening member 110*d* has a slope directed downward and inward so as to increase a contact area between the strengthening member 110*d* and the inserted pot. Alternatively, the strengthening member may extend upward and outward along the same angular direction as shown in FIG. 8*d*, and with similar effect.

Figure 7B:
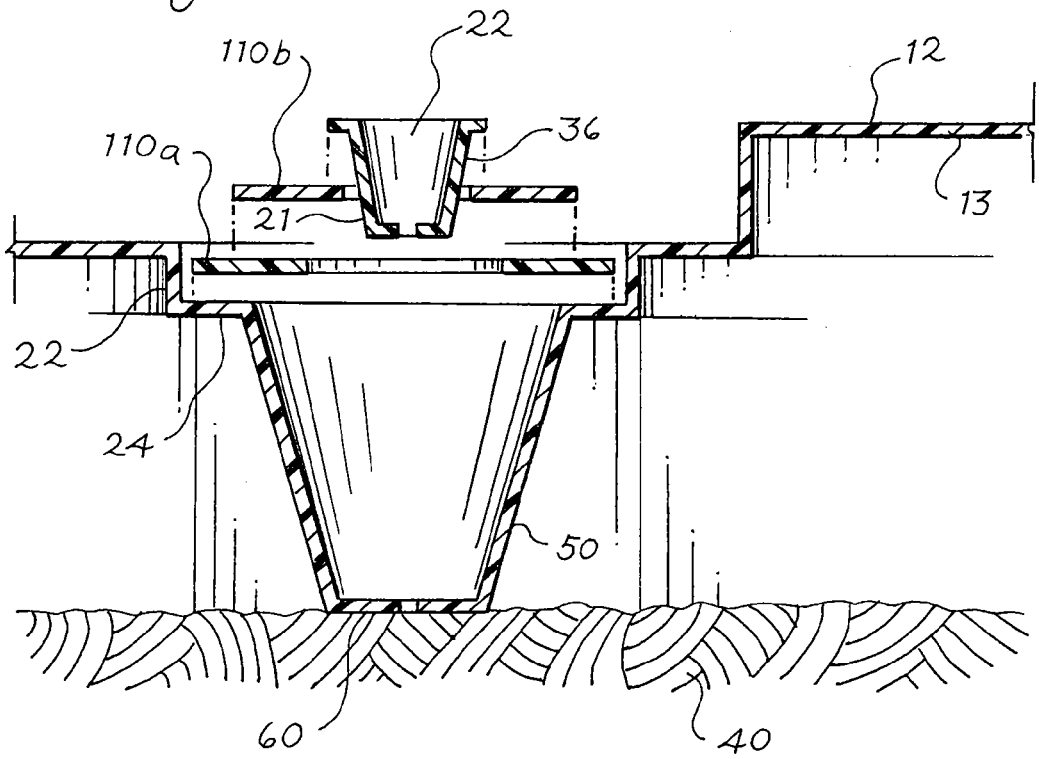
Figure 8E:
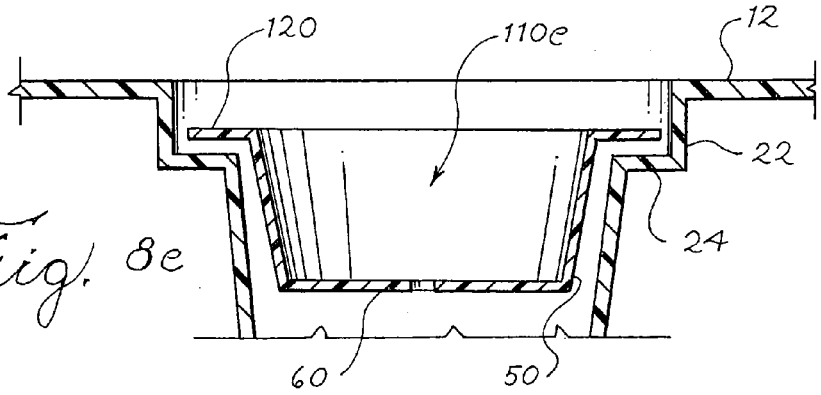

FIG. 8*e* shows another insert 110*e*, formed generally in the shape of a pot, and having a frustro-conical surface 50, lip 120 and bottom closure 60. This insert may be placed into the aperture 20 of a structure such as shown in FIG. 7*a*, and serve to support a pot 32 having a smaller diameter than supportable by the lip of the structure shown in FIG. 7*a*, or be placed on top of the insert 110*a*, shown in FIG. 7*b*, replacing the insert 110*b*.

Constructional details of the container are not shown in detail as such aspects will be dependent on the size of the container, the weight to be supported by each of the parts of the container, and by the material from which the container is fabricated. It is therefore intended that the foregoing detailed description be regarded as illustrative rather than limiting, and that it be understood that it is the following claims, including all equivalents, that are intended to define the spirit and scope of this invention.

What is claimed is:

1. An apparatus for receiving a pot, comprising:

a structure having a generally convex outer surface, an inner surface generally conforming to the outer surface, as viewed in cross-section, and a generally circular periphery, the outer surface and the inner surface being opposing surfaces of a solid material, an aperture formed in the structure, the aperture having a lip with a first diameter; and a disk-shaped structure having an outer diameter greater than the first diameter and an aperture with an inner diameter that is less than the first diameter, the disk-shaped structure being supported by the lip of the aperture of the structure when placed in a position above the lip of the structure;

wherein the inner surface of the structure and at least a portion of the disk-shaped structure faces an external support surface upon which the structure is positionable, without another surface of the structure being disposed therebetween; and, the lip is a surface extending to an edge of the aperture, the surface being depressed with respect to the generally convex outer surface of the structure.

2. The apparatus of claim 1, further comprising at least two tabs disposed along the periphery of the structure, the each tab having an aperture therein suitable for accepting a pin or a stake.

3. The apparatus of claim 1, wherein the outer surface of the structure is at least one of textured, formed, or colored so as to have the appearance of a natural rock.

4. The apparatus of claim 1, wherein the disk-shaped structure has an aperture formed in a central portion thereof having a horizontal surface extending to an edge of the aperture in the disk-shaped structure, the horizontal surface being depressed with respect to a surrounding surface of the disk-shaped structure.

* * * * *

UNITED STATES PATENT AND TRADEMARK OFFICE

CERTIFICATE OF CORRECTION

PATENT NO. : 8,434,260 B2
APPLICATION NO. : 12/976158
DATED : May 7, 2013
INVENTOR(S) : Stuart Hilbert It is certified that error appears in the above-identified patent and that said Letters Patent is hereby corrected as shown below:

In the Claims

In column 10, claim 2, line 49, after "periphery of the structure," delete "the".

Signed and Sealed this
First Day of April, 2014

Michelle K. Lee

Michelle K. Lee
*Deputy Director of the United States Patent and Trademark Office*